US008328196B1

(12) United States Patent
Kihslinger et al.

(10) Patent No.: US 8,328,196 B1
(45) Date of Patent: Dec. 11, 2012

(54) BOARD GAME

(76) Inventors: Robert Kihslinger, Madison, WI (US); Judy Kihslinger, Madison, WI (US)

( * ) Notice: Subject to any disclaimer, the term of this patent is extended or adjusted under 35 U.S.C. 154(b) by 0 days.

(21) Appl. No.: 12/853,915

(22) Filed: Aug. 10, 2010

Related U.S. Application Data

(60) Provisional application No. 61/293,943, filed on Jan. 11, 2010.

(51) Int. Cl.
*A63F 3/00* (2006.01)

(52) U.S. Cl. ..... 273/287; 273/243

(58) Field of Classification Search ..... 273/243, 273/261, 287
See application file for complete search history.

(56) References Cited

U.S. PATENT DOCUMENTS 2,587,242 A * 2/1952 Stringer ..... 273/247
3,672,680 A * 6/1972 Grey ..... 273/260
3,759,521 A * 9/1973 Breslow et al. ..... 273/243
4,477,080 A * 10/1984 Baker ..... 273/241
4,852,886 A * 8/1989 Zaruba et al. ..... 273/249
4,984,805 A * 1/1991 Medlock ..... 273/248
5,118,110 A * 6/1992 Jones ..... 273/141 R
5,709,384 A * 1/1998 Miller ..... 273/256
6,059,290 A * 5/2000 Neil ..... 273/243
6,189,887 B1 * 2/2001 Dommasch ..... 273/260
6,419,228 B1 7/2002 Egli et al.
6,471,207 B1 * 10/2002 Schlaifer ..... 273/138.1
6,669,197 B1 * 12/2003 Lund et al. ..... 273/243

FOREIGN PATENT DOCUMENTS

GB 2225729 A * 6/1990

* cited by examiner

*Primary Examiner* — Vishu K. Mendiratta
(74) *Attorney, Agent, or Firm* — Boardman & Clark LLP

(57) ABSTRACT

The present disclosure relates to a board game with a start point, end point, and a path between. The object of the game is to advance all of one's pawns from the starting point to the end point before any other player. In various exemplary embodiments, the game also includes a sweeper arm that comes into play at the occurrence of an arbitrary and/or random event (e.g., a particular roll of a dice or die), but the direction of movement is selected by a player (e.g., the player during whose turn the sweeper arm will be moved). The sweeper arm moves about the playing board and effects the position of pieces thereon (e.g., sending them back to the start point or changing their location on the board). In various exemplary embodiments, the playing pawns are stackable on one another. Moreover, multiple pieces may become stacked and move as a group, including pawns belonging to any number of different players.

11 Claims, 3 Drawing Sheets

BOARD GAME

PRIORITY

This application claims priority to U.S. Provisional Application 61/293,943 filed Jan. 11, 2010, which is incorporated herein by reference in its entirety.

BACKGROUND

1. Field of the Invention

The present disclosure relates to a board game. More particularly, it relates to a board game for two or more players where each player's objective is to be the first to move all of his playing pieces (referred to herein as "pawns") from a start point to a finish point.

2. Related Art

Board games with a start point and a finish point connected by a path where the objective is to move all of one or more playing pieces to the finishing point before any other player are well known. Examples of such games include the ubiquitous Sorry®, Trouble®, and Parcheesi®. The movement of the playing pieces is commonly determined by arbitrary or random, means such as, for example, with a die or a spinner. It is also a common element to many such games that two pawns may not occupy the same playing space, even when the two playing pieces are commonly owned. For example, when a pawn lands on a space occupied by another player's pawn (s), that player's pawn(s) is returned to its starting place. Success in such games is predominantly a function of chance rather than skill or strategy.

SUMMARY

The present disclosure relates to a board game for one or more players, comprising a playing surface comprising at least one start space, at least one end space, and a plurality of playing spaces on the board creating at least one path between a start space and an end space; at least one pawn associated with each player; and a rotating arm wherein the arm is able to move across at least a portion of the playing surface and interact with pawns thereon; and at least one random result generator.

The present disclosure also relates to a board game for one or more players, comprising a playing surface, at least one pawn associated with each player wherein the pawns are capable of stacking and wherein pawns assigned to different players may be stacked and moved together as a group.

The present disclosure further relates to a method for playing a board game comprising providing a playing surface with at least one start space, at least one end space, and a plurality of playing spaces creating a path between the at least one start space and the at least one end space; providing at least one pawn for each game player wherein the pawns are capable of stacking on one another; providing at least one rotating arm on the playing surface wherein the sweep of the arm defines an area including at least a portion of the playing surface; providing one or more random result generators; controlling the movement of the playing pieces using the results of at least one random result generators; controlling the movement of the arm using the results of at least one random result generator; and wherein two or more pawns on the same playing position are stacked and may move together as a group regardless of whether they are owned by the same player.

These and other features and advantages of various embodiments of systems and methods according to this invention are described in, or are apparent from, the following detailed description of various exemplary embodiments of various devices, structures, and/or methods according to this invention.

BRIEF DESCRIPTION OF THE DRAWINGS

Various exemplary embodiments of the systems and methods according to the present disclosure will be described in detail, with reference to the following figures, wherein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

The present disclosure relates to a board game for two or more players and preferably two to four players. In various exemplary embodiments, the playing surface has a unique start space and end space for each player and one or more concentric playing rings. The starting spaces are located around the outer circumference of the outermost ring and the ending spaces are located inside the innermost ring. The various rings are divided into a plurality of playing spaces. Each player has one or more playing pieces (referred to hereinafter as "pawns") each. Play proceeds with each player attempting to advance his pawns from his start space around each ring until reaching his end space in the inner ring. In various exemplary embodiments, a sweep arm extends across at least a part of the playing surface and rotates about the center of the playing surface. In various exemplary embodiments, the pawns are stackable and may move together as a group.

Figure 1:
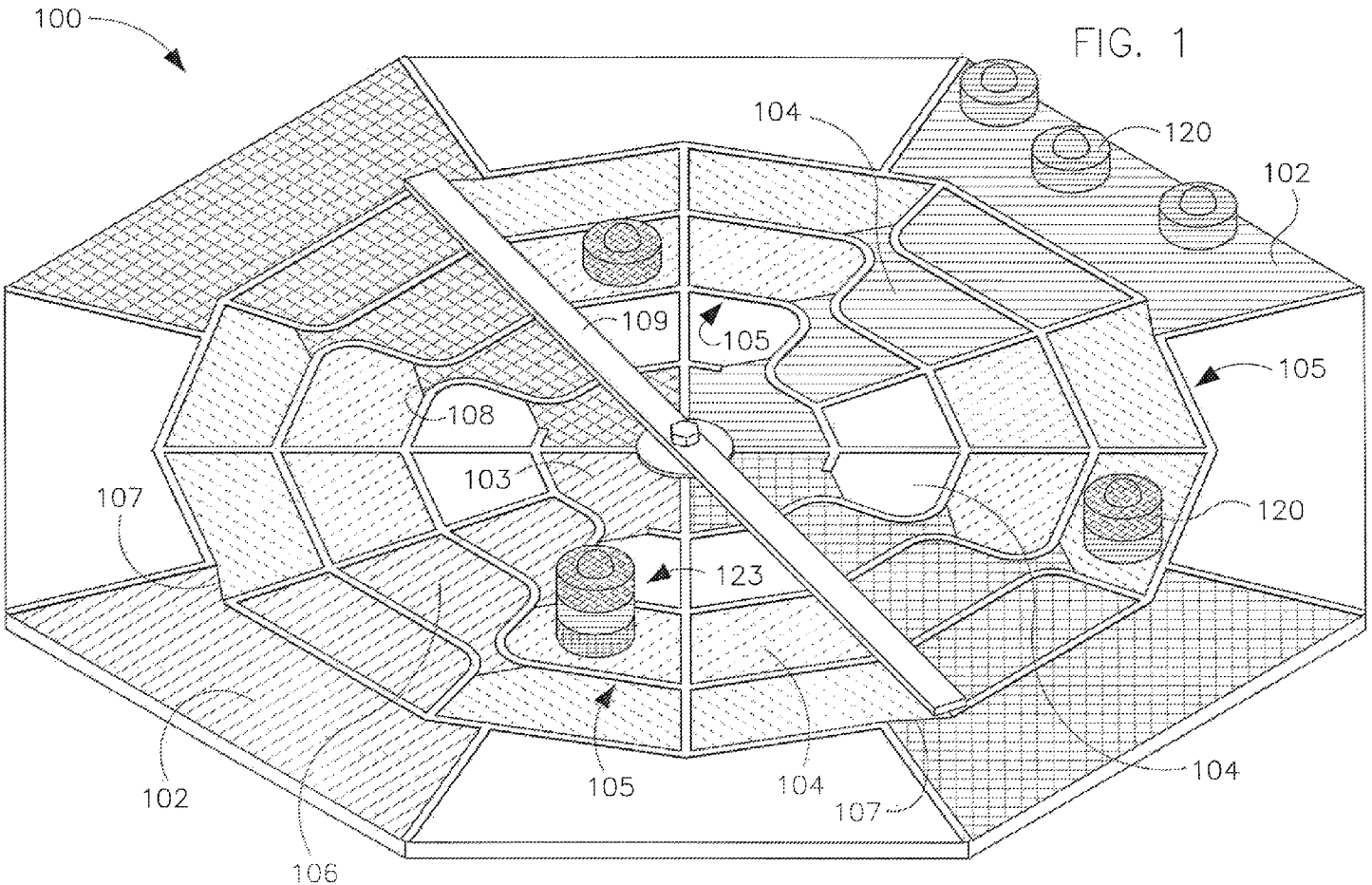
FIG. 1 is a perspective view of an exemplary embodiment of a playing board.
Figure 2:
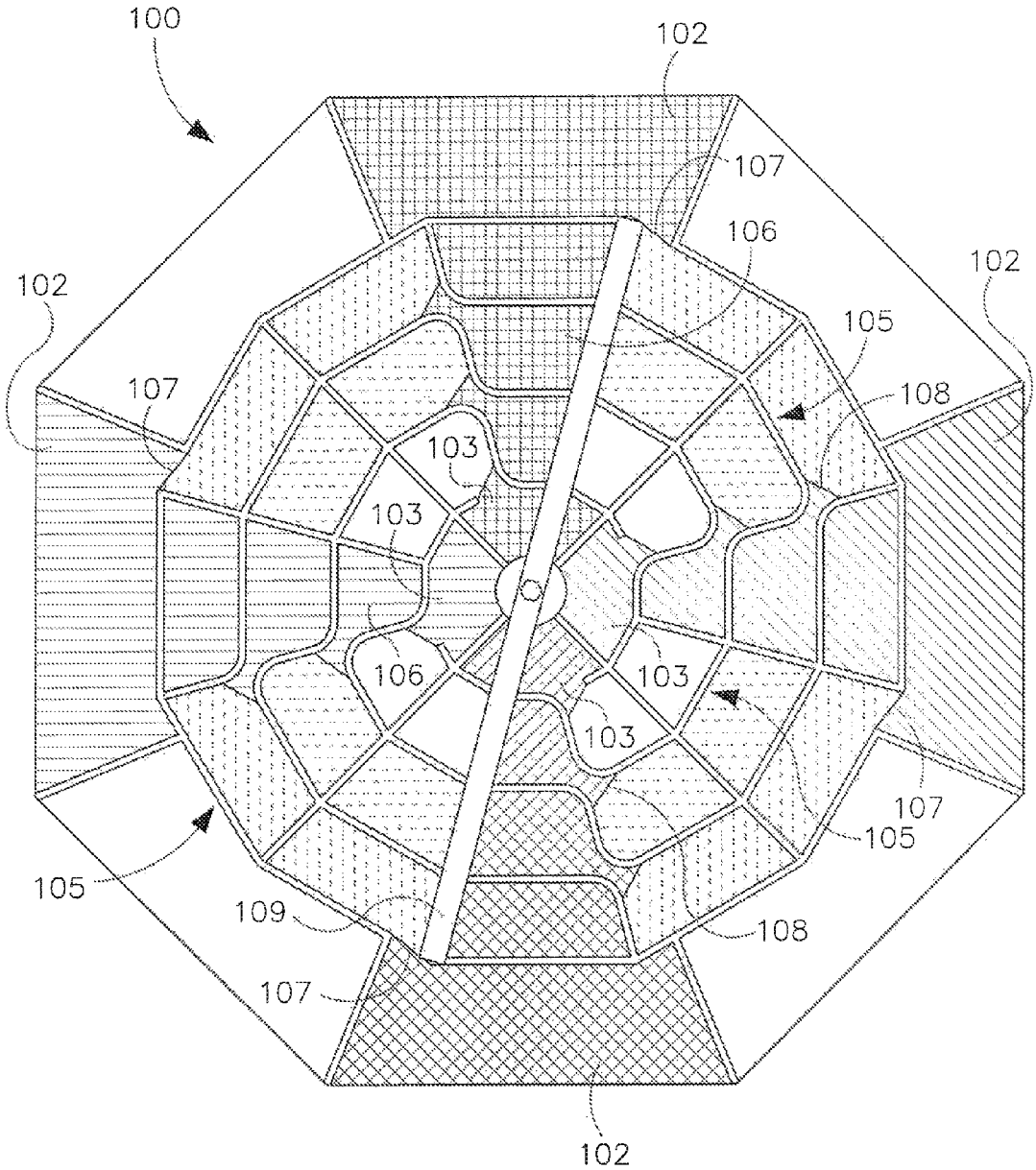
FIG. 2 is a top plan view of an exemplary embodiment of a playing board.

FIGS. 1 and 2 show an exemplary embodiment of a board 100 and playing surface. In various exemplary embodiments, the board 100 is shown as an octagon in shape, but may have other shapes (e.g., a circle or square). An outer ring of eight spaces alternates between four start spaces 102—one for each player—and four "dead" spaces (i.e., spaces that are not used as part of game play). An innermost ring has four home or end spaces 103-one for each player. The object of the game is to advance all pawns 120 from a respective player's start space 102 to his respective home space 103. In various exemplary embodiments, each player is associated with a color. Each player's pawns 120 include the player's assigned color or other indicia. Furthermore, certain playing spaces 104 on the board 100 (e.g., a start space 102) that are associated with a given player are also identified by inclusion therein of the respective player's color.

In various exemplary embodiments, the movement of pawns 120 is controlled by rolling two six-sided dice. In other exemplary embodiments, the number and size of die may be altered (e.g., more or fewer die and/or die with more or fewer sides may be substituted). One pawn 120 may be moved a number of playing spaces 104 equal to the total pips of the two die or two different pawns 120 may be moved with each moved a number of spaces equal to the pips shown on one of the two die (e.g., if the roll of the die is a three and a five, one pawn 120 is moved three spaces and another is moved five). In various exemplary embodiments, a pawn 120 may be moved out of the start space 102 on any roll. In other exemplary embodiments, a particular number on one or both die may be required (e.g., a roll of one may be required before a pawn 120 may leave the start space 102).

Between the outer ring and innermost rings, in various exemplary embodiments, are one or more playing rings 105. In various exemplary embodiments, as shown in FIG. 1, the playing rings 105 have twelve playing spaces 104 each. Four of these spaces are designated as a safety zone space 106 with one in each playing ring 105 for each of the players. In various exemplary embodiments, each player's respective safety zone space 106 is located in front of his respective start space 102 and identified with that player's designated color or marking.

In various exemplary embodiments, pawns 120 are placed in start space 102 to begin the game and exit the start space 102 through start space opening 107 into the outermost playing ring 105. The pawns 120 proceed around a playing ring 105 until they reach the ringdrop opening 108 in front of their respective start space 102. At that point, they may pass through ringdrop opening 108 into the next innermost ring 105. The pawns 120 continue spiraling inward in this manner until they have completed a circuit around the innermost playing ring 105. At that point, the pawn 120 may pass through a ringdrop opening 108 into its home space 103. In various exemplary embodiments, a roll equal to the exact number of spaces needed to reach the appropriate home space 103 may be required to enter the home space 103. If an exact roll is required, a roll exceeding the correct number of spaces may compel the player to move his pawn 120 past the ringdrop opening 108 and make another circuit around the innermost playing ring 105 or may not allow the player to move the piece at all. In various exemplary embodiments, a pawn 120 that has reached its home space 103 may be removed from the board 100 as it can advance no further. In various exemplary embodiments, as illustrated by FIGS. 1 and 2, pawns 120 move in a clockwise direction, but the playing surface may be designed for counterclockwise movement.

In various exemplary embodiments, as shown in FIGS. 1 and 2, a sweeper arm 109 turns about the center point of the board 100 and extends all or some of the playing rings 105. When moved, the sweeper arm 109 may move pawns 120 forward or backward around the playing rings 105. In various exemplary embodiments, the sweeper arm 109 is moved only when a given event occurs (e.g., when a certain roll of the die occurs). In various exemplary embodiments, movement of the sweeper arm 109 during a given player's turn may be triggered by a particular roll of the dice. For example, in various exemplary embodiments, a player must move the sweeper arm 109 in either direction one space for every "one" rolled on a die. In various exemplary embodiments, a roll of two "ones" (commonly referred to as "snake eyes") requires the sweeper arm 109 to be moved two spaces. In various exemplary embodiments, a roll of a "one" does not also cause a pawn 120 to be moved a corresponding one space. For example, in such embodiments, if a player rolled a "one" and a "four," the player could move an eligible pawn 120 four spaces and rotate the sweeper arm 109 one space. In various other exemplary embodiments, the movement of the sweeper arm 109 may be triggered by a different roll of the dice or by a separate action (e.g., the roll of a different die or the use of a spinner may determine if or how much the sweeper arm 109 is moved). Although the sweeper arm 109 is shown as straight, it should be noted that the sweeper arm 109 may have other shapes within the scope of the present disclosure, including asymmetrical shapes. Further, although the sweeper arm 109 is shown as extending across the diameter of the playing rings 105, the sweeper arm 109 may have a different reach (e.g., not reach the outermost playing ring 105) on one or both sides, including extending from the center in only one direction. The number of arms 109 extending out from the pivot point may also be varied.

In various exemplary embodiments, movement of the sweeper arm 109 may have any of one or more effects. In some exemplary embodiments, any pawns 120 that are touched by the sweeper arm 109 are removed from the playing space 104 and sent to their respective start spaces 102. In various other exemplary embodiments, the pawns 120 contacted by the sweeper arm 109 are moved by the sweeper arm 109 into a different playing space 104 on the board 100. In such exemplary embodiments, pawns 120 being pushed by the sweeper arm 109 may not move to a different playing ring 105 even if they pass one of their respective ringdrop openings 108. In various exemplary embodiments, pawns 120 in a safety zone space 106 are protected and remain in the safe zone space.

In various exemplary embodiments, the sweeper arm 109 may be moved in either direction at the choice of a given player (e.g., the player which is having its turn) or may be required to move in a given direction (e.g., always clockwise, always counterclockwise, or alternating between clockwise and counterclockwise). In various other exemplary embodiments, movement of the sweeper arm 109 pushes any pawns 120 in its path forward or backward around the playing rings 105. In various other exemplary embodiments, the direction of the arm's movement may be controlled by the random result generator (e.g., direction and/or distance may be indicated on the face of a die).

Figure 3:
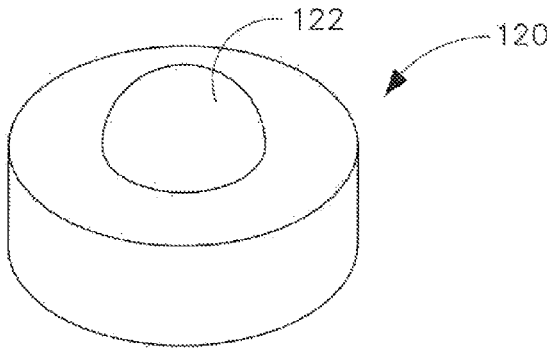
FIG. 3 is a top perspective view of an exemplary embodiment of a game playing piece.
Figure 4:
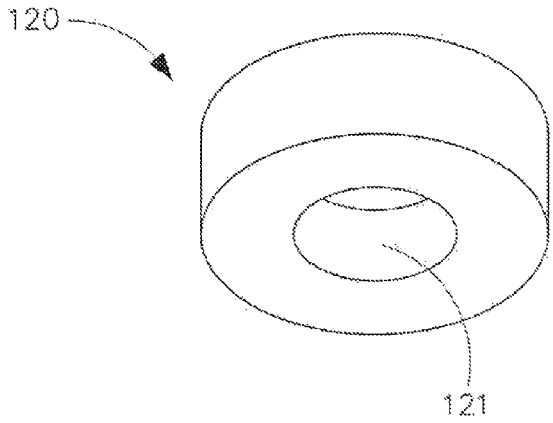
FIG. 4 is a bottom perspective view of a game playing piece according to the embodiment of FIG. 3.

In various exemplary embodiments, as shown in FIG. 3, the pawns 120 are round and have a predominantly flat top with a dome in about the middle. As shown in FIG. 4, the bottom surface of the pawn 120 includes a cavity that is designed to fit over the dome. This allows the pawns to be stacked in nested fashion, as illustrated in FIG. 5.

Figure 5:
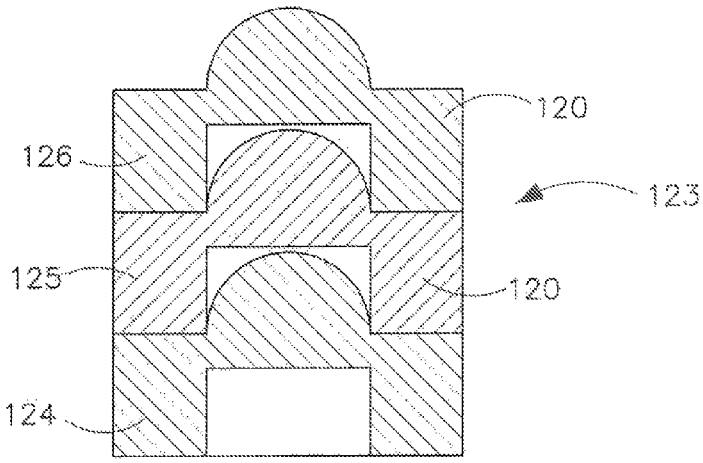
FIG. 5 is a side cross-sectional view of a stack of game playing pieces according the embodiment of FIG. 3.

In various exemplary embodiments, as shown in FIGS. 1 and 5, the pawns 120 are designed to stack up on one another and move together as a group. In various exemplary embodiments, when a pawn 120 or stack 123 of pawns lands on a space occupied by another pawn 120 or stack 123 of pawns, it is placed on top of the pawn 120 or stack 123 of pawns. In various exemplary embodiments, two or more pawns 120 cannot occupy the same playing space 104 without being in a single stack 123 of pawns.

In various exemplary embodiments, a stack 123 of pawns may be moved only by the player who owns the bottom pawn 124 and it's movement is governed by the path for that pawn (e.g., it may move to the next inner ring only through a ringdrop opening 108 assigned to that player). In another exemplary embodiment, the top pawn 126 controls the stack 123 and the owner of that pawn may elect to move the entire stack 123 or to remove their pawn from the stack 123 moving it alone. In various other exemplary embodiments, any player with a pawn 120 in the stack 123 may move the entire stack 123. In various exemplary embodiments, the rules that apply to the movement of a single pawn 102 by a given player apply to the movement of a stack 123 of pawns by that particular player (e.g., the number of spaces moved and the use of ringdrop openings 108).

In various exemplary embodiments, only the top pawn 126 may leave a stack 123. For example, during the turn of a player owning the top pawn 126 of a stack 123, the player may elect to move his pawn off the stack 123 according to the rules for pawn movement described above. Thus, the owner of an interior pawn 125 (e.g., a pawn 120 in a stack 123 that is not the bottom pawn 124 or the top pawn 126) cannot move that pawn. In another exemplary embodiment, any player with a pawn 120 in a stack 123 may move that pawn 120 and any pawns 120 above it, but must leave behind any pawns below their pawn. It should be noted that in embodiments with assigned home spaces 103, a stack 123 of pawns belonging to different players cannot enter any home space 103 together. Thus, in some embodiments, only the top pawn 126 may enter a home space 103 by leaving the stack 123. In other embodiments, such as those where the bottom pawn controls the movement of the stack 123, the bottom pawn 124 may drop the rest of the stack 123 and enter its home space 103.

In various exemplary embodiments, the sweeper arm 109 affects all pawns 120 in a stack 123 in the same manner as an individual pawn would be affected. In various other exemplary embodiments, the sweeper arm 109 affects only some of the pawns (e.g., top pawn only, bottom pawn only, all but top or bottom pawn, etc.).

In various exemplary embodiments, players may play as individuals or as a team. For example, four players may play as two teams of two players. Team play proceeds as outlined above except that a player may carry his teammate's pawns off the board 100 (e.g., into his home space 103) in a stack 123.

It should be appreciated that the construction and arrangement of the board game, as shown in the various exemplary embodiments, is illustrative only. While the board game, according to this invention, has been described in conjunction with the exemplary embodiments outlined above, various alternatives, modifications, variations, improvements, and/or substantial equivalents, whether known or that are or may be presently unforeseen, may become apparent. Accordingly, the exemplary embodiments of the board game, according to this invention, as set forth above, are intended to be illustrative, not limiting. Various changes may be made without departing from the spirit and scope of the invention. Therefore, the description provided above is intended to embrace all known or later-developed alternatives, modifications, variations, improvements, and/or substantial equivalents.

What is claimed is:

1. A board game comprising:

a game board having three concentric rings disposed about a central position provided on a playing surface, each ring having twelve sequential spaces defining the perimeter of each ring, and a sweeper arm rotatably coupled to the central position and having a length corresponding to at least a diameter of an outermost ring, wherein for each player:

a first outermost ring space corresponding to a start space is provided on the outermost ring, followed by ten sequential spaces provided on the outermost ring leading to a twelfth outermost ring space provided on the outermost ring;

the twelfth outermost ring space is coupled to a first middle ring space provided on a middle ring by a first passage;

ten sequential spaces are provided on the middle ring leading to a twelfth middle ring space provided on the middle ring;

the twelfth middle ring space is coupled to a first innermost ring space provided on an innermost ring by a second passage;

ten sequential spaces are provided on the innermost ring leading to a twelfth innermost ring space provided on the innermost ring; and a home space is coupled to the twelfth innermost ring space, the home space is provided between the innermost ring and the central position provided on the playing surface;

at least three game pieces for each player; and a random number generator.

2. The board game of claim 1, wherein the first outermost ring space, the first middle ring space, and the first innermost ring space are in approximate radial alignment outward from the central position provided on the playing surface.

3. The board game of claim 2, wherein the first outermost ring space, the first middle ring space, and the first innermost ring space are a first color which is different from colors of the remaining spaces provided on the outermost ring, middle ring, and innermost ring.

4. The board game of claim 1, wherein the first outermost ring space abuts the twelfth outermost ring space.

5. The board game of claim 4, wherein the first middle ring space abuts the twelfth middle ring space.

6. The board game of claim 5, wherein the first innermost ring space abuts the twelfth innermost ring space.

7. The board game of claim 1, wherein the game pieces for each player are pawns.

8. The board game of claim 7, wherein each of the pawns include a first side having an arcuate projection opposite a second side having an arcuate cavity, the arcuate cavity of each pawn being adapted to removably receive the arcuate projection of another pawn to allow for the stacking of pawns.

9. The board game of claim 1, wherein each of the players share the outermost, middle, and innermost rings of the game board.

10. The board game of claim 9, wherein the start space for each player is provided on a separate, unique space of the outermost ring.

11. The board game of claim 1, wherein the random number generator is at least one six-sided die.

* * * * *